United States Patent [19]

Barbee

[11] 4,187,050

[45] Feb. 5, 1980

[54] QUICK-DISCONNECT MECHANICAL COUPLING

[75] Inventor: Gail G. Barbee, Montgomery, Ill.

[73] Assignee: Caterpillar Tractor Co., Peoria, Ill.

[21] Appl. No.: 878,140

[22] Filed: Feb. 15, 1978

[51] Int. Cl.[2] ..... E02F 3/70

[52] U.S. Cl. ..... 414/723; 172/272; 403/92; 414/686

[58] Field of Search ..... 214/145 A, 140, 620; 172/212, 272, 273, 274; 280/421; 403/92, 102, DIG. 4; 414/607, 686, 697, 723

[56] References Cited

U.S. PATENT DOCUMENTS

| | | | |
|---|---|---|---|
| 3,115,261 | 12/1963 | Antolini | 172/273 |
| 3,572,760 | 3/1971 | Jones | 172/272 |
| 3,606,052 | 9/1971 | Schurz | 214/145 A |

FOREIGN PATENT DOCUMENTS

| | | | |
|---|---|---|---|
| 471251 | 2/1974 | Australia | 214/145 A |

*Primary Examiner*—Stephen G. Kunin
*Assistant Examiner*—George F. Abraham
*Attorney, Agent, or Firm*—Wegner, Stellman, McCord, Wiles & Wood

[57] ABSTRACT

A quick-disconnect coupling for fixing tools or the like to a powered arm including a base, mounting structure on the base for affixing the same to an arm, a pair of hooks having oppositely facing openings, one of the hooks being immovably mounted on the base and the other being movably mounted on the base, and a latch movably mounted on the base and engageable with the movably mounted hook for preventing movement thereof. Interengaging cam surfaces are disposed on the movably mounted hook and the latch whereby the hook may cam the latch aside while moving to a latched position and there are also provided interengaging surfaces on the movably mounted hook and the latch so that forces applied to the latch by the hook, when the hook is latched, will not tend to move the latch to release the hook.

10 Claims, 6 Drawing Figures

QUICK-DISCONNECT MECHANICAL COUPLING

BACKGROUND OF THE INVENTION

This invention relates to quick-disconnect, mechancial couplings which are particularly suited for, but not limited to, use in affixing tools to a powered arm or the like.

Various powered tools as, for example, earth-working vehicles, periodically require differing work-performing means to provide adaptability. For example, excavators may be provided with a variety of differing size buckets, each having specific advantages and disadvantages. The uses to which such excavators are put may require a change from one bucket to another when the excavator is shifted from one job to another and, in some cases, may require the changing of buckets during the performance of a single job.

Heretofore, the buckets have been changed through time-consuming manual processes involving the removal of force-fit pins or the like, or, through the use of specially fabricated adapters, or, through the use of expensive and complex coupling devices which frequently require specially designed tools.

SUMMARY OF THE INVENTION

The present invention is directed to overcoming one or more of the above problems.

According to the present invention, there is provided a quick-disconnect coupling including a base, a pair of hooks having oppositely facing openings, means immovably mounting one of the hooks on the base, means movably mounting the other of the hooks on the base, and a latch movably mounted on the base and engageable with the movable hook for preventing movement thereof.

Other objects and advantages will become apparent from the following specification taken in connection with the accompanying drawings.

DESCRIPTION OF THE PREFERRED EMBODIMENT

A typical intended use of a coupling made according to the invention is in the area of excavators of the backhoe type. However, it will be appreciated that the coupling is not limited to such a use but may be employed with efficacy in a variety of other applications.

Figure 1:
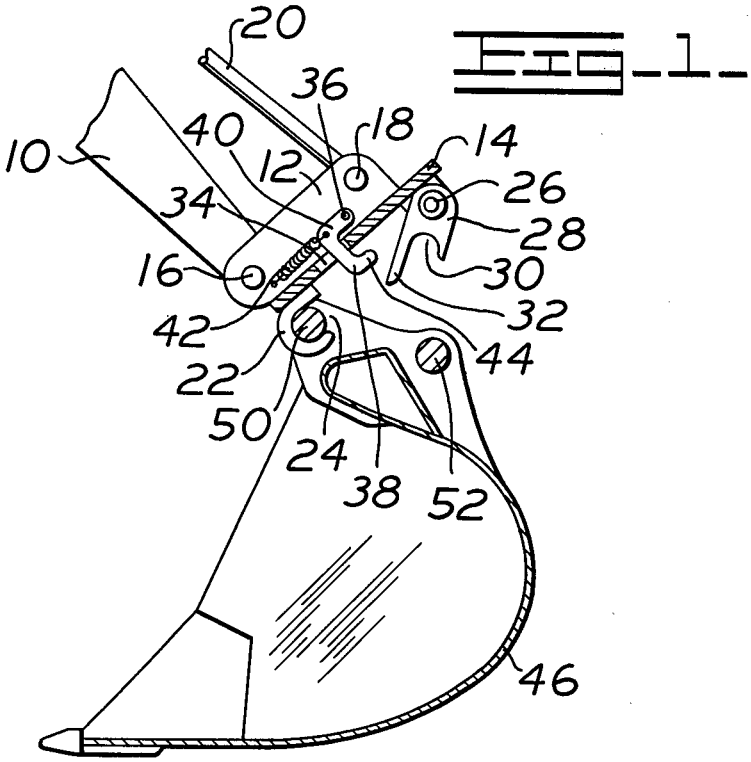
FIG. 1 is a vertical section of a powered arm, as for example, found in a typical excavator backhoe construction, employing a coupling made according to the invention at a point in an initial stage of the application of the same to a tool, namely, a bucket.
Figure 6:
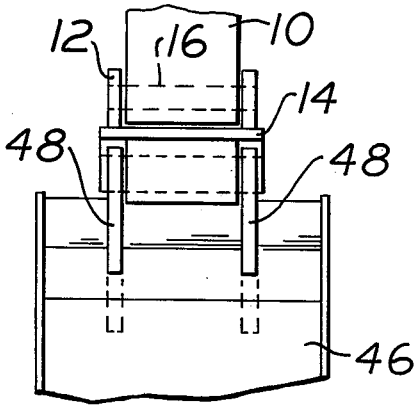
FIG. 6 is an elevational view of the arm, coupling and tool assembled thereto.

With reference to FIGS. 1 and 6, the typical backhoe type excavator will include a so-called "stick" 10 having an end disposed between upstanding ears 12 mounted on a coupling base plate 14. A pivot pin 16 interconnects the stick 10 and the coupling base late 14. A further pivot pin 18 pivotally connects the ears 12 to the rod 20 of a hydraulic cylinder (not shown). When the rod 20 is extended from the cylinder, the coupling base plate 14 will be rotated about the pivot point 16 in a generally clockwise direction, as viewed in the Figures, while when the rod 20 is retracted, counterclockwise rotation will occur.

On the side of the base plate 14 opposite from the ears 12, the base plate 14, near one edge thereof, mounts a hook 22 having an opening 24. The hook 22 is immovably fixed to the base plate 14, as by welding, bolts, or any other suitable securing means.

The opposite edge of the base plate 14, on the side remote from the ears 12, mounts a pivot pin 26 by which a hook 28 is pivotally mounted on the base plate 14. The hook 28 has an opening 30. It will be observed that in the exemplary embodiment, the openings 24 and 30 of the hooks 22 and 28 face each other and such an orientation is preferred. However, those skilled in the art will readily recognize that it is only necessary that the openings 24 and 30 extend in opposite directions.

The pivotally mounted hook 28 includes a finger 32 extending along one side of the opening 30 and away from the pivot 26. The purpose of the finger will be described hereinafter.

The base plate 14 includes an opening 34 and a pivot pin 36 extending between the ears 12 pivotally mounts a U-shaped latch 38 by one leg 40 thereof. A tension spring 42 is secured between the leg 40 and one of the ears 12 so as to urge the latch 38 in a counterclockwise direction, as viewed in the Figures. The latch 38 includes an additional leg 44 which is operative to capture the finger 32 on the pivotal hook 28 and restrain the same in a coupling position.

The work performing means illustrated in FIG. 1 is in the form of a bucket 46, as is typically used with an excavator. The upper surface of the same mounts spaced ears 48 and spaced shafts 50 and 52 extend between the ears 48. The shafts 50 and 52 are complementary to the openings 24 and 30 of the hooks 22 and 28 and those skilled in the art will recognize that the configuration of the shafts 50 and 52 as well as their orientation with respect to the remainder of the bucket 46 is conventional so as to allow the use of the invention with conventional, presently available equipment without the use of adapters.

Figure 2:
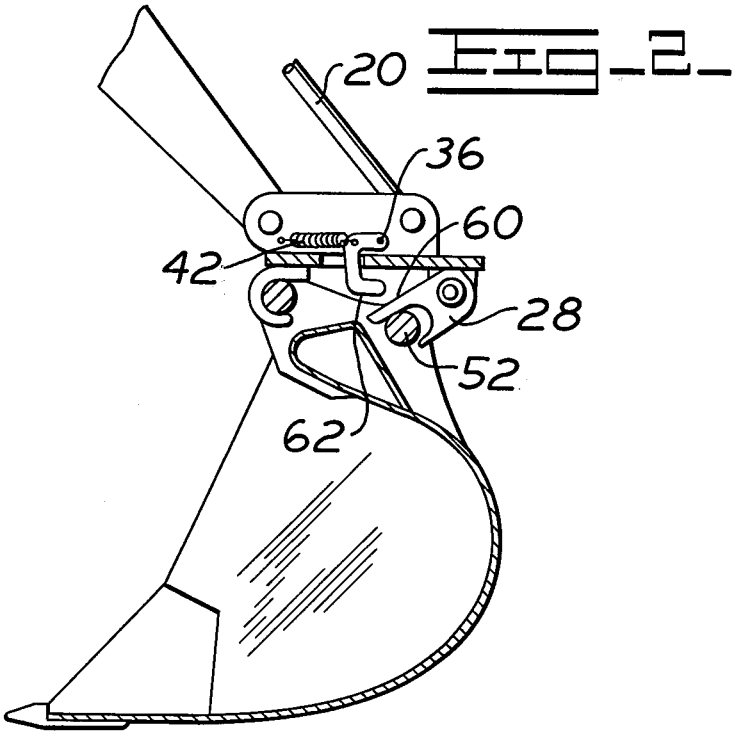
FIG. 2 is a view similar to FIG. 1 but illustrating the configuration of the components at a subsequent stage in the mounting process.

In coupling the bucket 46 to the stick 10, with the pivotal hook 28 released from a coupling position and substantially in the attitude illustrated in FIG. 1, the operator of the excavator will retract the rod 20 of the cylinder to cook the base plate 14 to a position like that illustrated and move the stick 10 until the shaft 50 enters the opening 24 of the immovable hook 22. At this point in time, the operator will then extend the rod 20 and as the extension occurs, the components will assume a configuration such as that illustrated in FIG. 2. At this time, the shaft 50 will remain captured within the opening 24 of the hook 22 while the shaft 52 will have partially entered the opening 30 in the pivotal hook 28.

Further extension of the rod 20 will cause the upper surface 60 of the movable hook 28 to engage the undersurface 62 of the leg 44 of the latch 38. By means to be described hereinafter, a camming action will occur which will result in the latch 38 being cammed in a clockwise direction about its pivot 36 and against the bias of the spring 42 as the rod 20 continues to extend.

Figure 3:
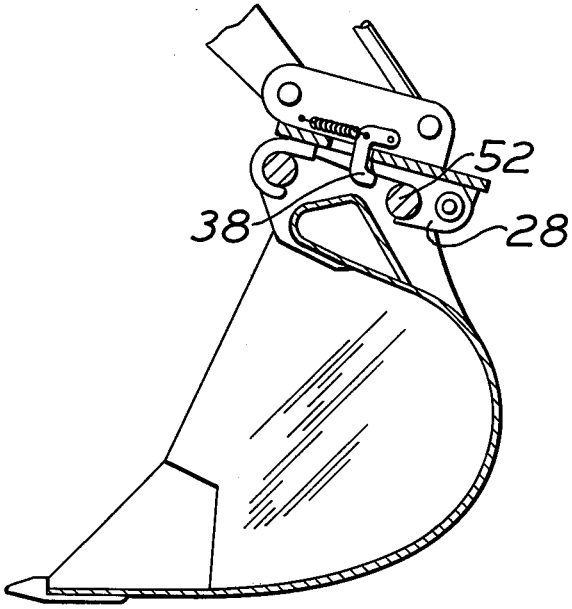
FIG. 3 is a view similar to FIGS. 1 and 2 but illustrating the tool fully secured to the coupling.

At some point in time, the end of the leg 38 will pass the end of the finger 32 such that the finger 32 will enter the space between the leg 38 and the base plate 14 at which time the bias applied to the latch 38 by the spring 42 will cause the latch 38 to assume the position illustrated in FIG. 3. At this time, the shaft 52 will be firmly captured by the pivotal hook 28 which has now moved to a coupling position and which is held in such a position by the latch 38.

Figure 4:
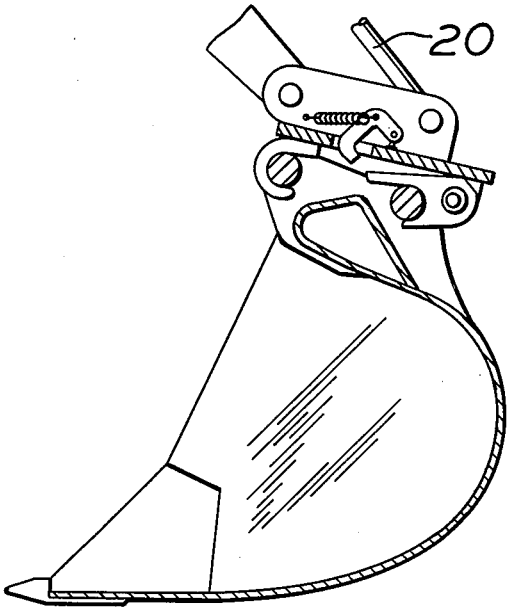
FIG. 4 is a view similar to FIGS. 1–3, but illustrating an initial stage of disconnecting the tool from the coupling.

To release the tool or bucket 46 for change purposes, it is only necessary to pivot the latch 38, manually, to the position illustrated in FIG. 4 to release the finger 32 and retract the rod 20. As soon as the base plate 14 has cocked somewhat, the latch 28 will be pivoted due to its engagement with the shaft 52 and the weight of the bucket 46 attached thereto. Complete release of the bucket 46 is obtained by reversing the previous sequence of steps.

Figure 5:
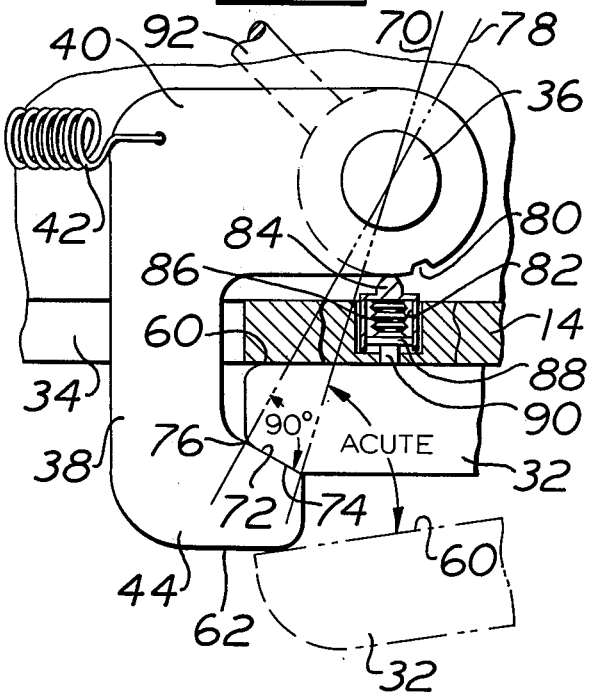
FIG. 5 is an enlarged, fragmentary view of a portion of a latch embodied in the coupling.

To minimize the need for manual intervention, and to provide reliability of the latch notwithstanding the heavy loads that may be applied to the various components, certain dimensional relationships are highly preferred to the invention. With reference to FIG. 5, the interengaging cam surfaces 60 and 62 of the fingers 32 and legs 44, respectively, are illustrated in detail. The dotted line showing in FIG. 5 illustrates the relative orientation of the two at the point of first engagement of the finger 32 with the latch 38 during the coupling process. It will be observed that the surface 60, at its point of contact with the surface 62, is at an cute angle (less than 90°) with a radial line 70 extending through the pivot 36 for the latch 38 and the initial point of engagement of the surfaces 60 and 62. As a result of this configuration, the latch 38 will be cammed clockwise during the coupling process so that it need not be moved out of the way manually.

FIG. 5 also illustrates the interrelationship between the inner surface 72 of the leg 44 and the opposing surface 74 of the finger 32 in solid line form. The surfaces 72 and 74 are latching surfaces for the finger 32 and the components will generally have the configuration illustrated in FIG. 5 with the finger 32 in substantial abutment with the plate 14. It is to be noted that a point on the surface 72 of the latch 38 which is engaged by the point 76 of the surface 74 most remote from the pivot 26 for the movable hook 28 is transverse, i.e., at 90° to a radial line extending through the pivot 36 and the point 76. Thus, loads applied by the bucket 46 to the hook 28 tending to pivot the same along with the finger 32 will be applied to the latch 39 directly along the line 78 with the consequence that there will be no tendency to cam the latch 38 in a clockwise direction which would result in unwanted unlatching of the finger 32.

To facilitate uncoupling, means are provided for temporarily holding the latch 38 in the position illustrated in FIG. 4. Specifically, the inner surface of the leg 40 is provided with a notch 80 and a bore 82 is disposed in the plate 14. A movable projection 84 is disposed within the bore 82 for reciprocating movement therein and a stack of compression springs 86 in the form of Belleville washers abut the projection 84. A plunger 88 abuts the stack of springs 86 oppositely from the projection 84 and includes an extension 90 which may be engaged by the surface 60 of the finger 30. Thus, when the finger 32 is in the position illustrated in FIG. 5, the stack of springs 86 is compressed to apply a biasing force on the projection 84. A handle 92 secured to the pivot 36 may be manually rotated to bring the recess 80 into alignment with the projection 84 and when such occurs, a detent action will occur, holding the latch 38 in the position illustrated in FIG. 4.

As soon as the finger 32 begins to pivot away from the base plate 14, the pressure applied by the same to the plunger 90 is released, allowing the same to shift downwardly within the bore 88 to release the compression force applied to the projection 84 by the stack of springs 86. Upon the release of such a compressive force, the bias applied by the spring 42 is sufficient to cam the projection 84 out of the recess 80 and return the latch 38 to the projection illustrated in FIG. 5 whereat it is ready for the next coupling sequence.

From the foregoing, it will be appreciated that a quick-disconnect coupling made according to the invention is inexpensively fabricated and utilizes relatively uncomplex components. It may be easily operated by a single operator, normally the operator of the excavator if used in that environment, and requires the operator of the excavator to leave the excavator only for the purpose of rotating the latch 38 to the position illustrated in FIG. 4. At that time, the operator may then enter the excavator and perform the uncoupling sequence, there being no need to maintain an unlatching force on the latch 38 by reason of the detent action provided by the projection 84 and the recess 80.

At the same time, once uncoupling has been effected, no further manual operations need be performed externally of the excavator since the components will automatically reassume the configuration required for the coupling sequence to be initiated.

Finally, the unique configuration of the latching surfaces on the latch and the finger ensures that uncoupling cannot inadvertently occur during use of the work performing structure.

The embodiments of the invention in which an exclusive property or privilege is claimed are defined as follows:

1. A quick-disconnect coupling for affixing tools to a powered arm or the like, comprising:

a base;

means on said base for affixing the same to an arm or the like;

a pair of hooks having facing openings;

means immovably mounting one of said hooks on said base;

means movably mounting the other hook on said base for movement between tool engaging and tool disengaging positions;

a latch movably mounted on said base and engageable in a latching position with said other hook for preventing movement thereof from said tool engaging position;

cooperating means on said other hook and said latch for moving said latch out of said latching position as said other hook moves from said tool disengaging position toward said tool engaging position; and means for moving said latch to said latching position in response to said other hook moving into said tool engaging position to engage said other hook and hold the same in said tool engaging position.

2. The quick-disconnect coupling of claim 1 wherein said other hook is pivotally mounted on said base.

3. The quick-disconnect coupling of claim 1 wherein said latch is pivotally mounted on said base.

4. The quick-disconnect coupling of claim 1 wherein both said latch and said other hook are pivotally mounted on said base.

5. A quick-disconnect, mechanical coupling comprising:

a base;

a first hook immovably mounted on said base and having an opening facing in a given direction;

a second hook having an opening facing a direction opposite of said first hook opening;

a pivot mounting said second hook on said base;

a finger on said second hook and extending away from said pivot and generally in said opposite direction;

a U-shaped latch opening toward said finger;

an additional pivot mounting one leg of said latch to said base;

interengaging cam surfaces on said latch other leg and said finger, the cam surface on said finger being configured such as to be at an acute angle to a radial line extending through said additional pivot upon initial engagement of said cam surfaces to cam said latch about said additional pivot until said finger is received in said latch.

6. The quick-disconnect, mechanical coupling of claim 5 including further interengaging surfaces on said latch other leg and said finger and being respectively oppositely disposed from said interengaging cam surfaces, the further interengaging surface on said other leg at the point thereon of engagement with the finger engaging surface most remote from said hook pivot being transverse to a radial line extending through said additional pivot and said point.

7. A quick-disconnect, mechanical coupling comprising:

a base;

a first hook immovably mounted on said base and having an opening facing in a given direction;

a second hook having an opening facing a direction opposite of said first hook opening;

a pivot mounting said second hook on said base;

a finger on said second hook and extending away from said pivot and generally in said opposite direction;

a U-shaped latch opening toward said finger;

an additional pivot mounting one leg of said latch to said base; and interengaging latch surfaces on said latch other leg and said finger, the latch surface on said other leg at the point thereof of engagement with said finger latch surface most remote from said hook pivot being transverse to a radial line extending from said additional pivot to said point.

8. A quick-disconnect, mechanical coupling comprising:

a base;

a first hook immovably mounted on said base and having an opening facing in a given direction;

a second hook having an opening facing a direction opposite of said first hook opening;

a pivot mounting said second hook on said base for rotation between a first coupling position and a second uncoupled position;

a latch selectively movably mounted on said base for holding said second hook in said first position;

a detent for holding said latch in a position releasing said second hook for movement to said position; and means for actuating said detent when said second hook is in said first position and for deactuating said detent when said second hook has moved from said first position.

9. The quick-disconnect coupling of claim 8 wherein said detent comprises a notch in said latch and a projection movably mounted on said base and adapted to enter said notch, and a compression spring adapted to urge said projection into said notch; and said actuating means comprises a plunger engageable by said second hook when in said first position for compressing said spring against said projection.

10. A tool including work-performing means and having a pair of generally parallel mounting shafts, the quick-disconnect coupling of claim 8 being received on said shafts with one of said shafts being disposed in said first hook opening and the other of said shafts being received in said second hook opening.

* * * * *